United States Patent [19]

Giroux et al.

[11] Patent Number: 5,064,311

[45] Date of Patent: Nov. 12, 1991

[54] MINE ROOF SUPPORT STRUCTURE AND METHOD

[75] Inventors: Roger Giroux, Azilda, Canada; Raymond L. Wright, Syracuse, N.Y.

[73] Assignee: The Eastern Company, Naugatuck, Conn.

[21] Appl. No.: 504,608

[22] Filed: Apr. 5, 1990

[30] Foreign Application Priority Data

Mar. 8, 1990 [CA] Canada ..... 2011774

[51] Int. Cl.[5] ..... F21D 21/02

[52] U.S. Cl. ..... 405/259.1; 405/259.5; 405/259.4; 411/11; 411/302

[58] Field of Search ..... 405/259, 260, 261; 411/10, 11, 301, 302, 431, 432

[56] References Cited

U.S. PATENT DOCUMENTS

| | | | |
|---|---|---|---|
| 97,752 | 12/1869 | Billings | 411/301 |
| 2,188,356 | 1/1940 | Jeans et al. | 85/62 |
| 2,330,999 | 10/1943 | Ruthven | 411/302 X |
| 2,333,388 | 11/1943 | Poupitch | 411/302 |
| 3,090,203 | 5/1963 | Durget | 405/259 |
| 3,940,941 | 3/1976 | Libert et al. | 405/261 |
| 4,322,193 | 3/1982 | Stahl | 411/11 |
| 4,619,559 | 10/1986 | Norris | 405/259 |
| 4,662,795 | 5/1987 | Clark et al. | 405/261 |

*Primary Examiner*—David H. Corbin
*Assistant Examiner*—Arlen L. Olsen
*Attorney, Agent, or Firm*—Charles S. McGuire

[57] ABSTRACT

An assembly and methods of installation thereof for supporting and stabilizing a rock structure adjacent a mine tunnel or other underground passageway. The assembly includes an elongated bolt, threaded from both ends for at least a portion of its length. A conventional, mechanical expansion anchor is threaded on one end of the bolt, within a drill hole in the rock structure, and a bearing plate, washer, jam nut and tensioning nut are carried on the other end, outside the drill hole. The tensioning nut is threaded into firm engagement with the jam nut to prevent further threaded advance of the tensioning nut a substantial distance from the termination of the threads. A torque applied to the tensioning nut thus rotates the bolt and expands the anchor shell into gripping engagement with the bore hole wall; torque producing an axial load on the jam nut in excess of its strength causes it to fracture or strip from threaded engagement with the bolt, permitting travel of the tensioning nut. The jam nut is received in a recess in the lower surface of the washer, which is preferably spherical on its upper surface.

15 Claims, 1 Drawing Sheet

MINE ROOF SUPPORT STRUCTURE AND METHOD

BACKGROUND OF THE INVENTION

The present invention relates to rock supporting or reinforcing structure and, more particularly, to an improved combination of structure including a bolt threaded at both ends, and methods of installation thereof, to achieve improved tensioning of the bolt within the drill hole and thus improved support of the surrounding rock structure.

In mine work, such as coal mining, or in underground formations such as tunnels or other excavations, it is necessary to reinforce or support the roof and/or walls of the excavation to prevent rock falls or cave-ins. Among the most common means presently in use for effecting such support are elongated bars or bolts which are inserted into blind drill holes and anchored therein to hold a metal support or bearing plate in tight engagement with the roof or wall surface. Anchoring means within the drill hole normally comprise a mechanical expansion anchor including an expansible shell and a camming plug threadedly engaged on the end of the bar inside the drill hole, and/or a hardenable resin or other grouting.

In addition to anchoring a first end of the bar in the drill hole, it is also desirable that the bar be placed in tension in order to reinforce the rock formation surrounding the excavation. Tensioning means employed in the prior art include a system wherein the bar is in the form of a bolt threaded for some distance from each end. A mechanical expansion anchor is threadedly engaged with the end of the bolt inside the drill hole and a tensioning nut is threadedly engaged with the other end, outside the drill hole. The tensioning nut bears against a washer which is inserted over the end of the bolt between the tensioning nut and the bearing plate. In the intended manner of installation, torque applied by a wrench to the tensioning nut rotates the bolt and causes the camming plug to travel down the threads on the end of the bolt within the drill hole and expand the shell radially into tight engagement with the bore hole wall. Continued torque applied to the tensioning nut after the expansion anchor is set causes the tensioning nut to travel up the threads on the end of the bolt outside the drill hole, thereby tensioning the bolt and placing the surrounding rock structure in compression.

A major problem which has been encountered in the installation of such support/reinforcement systems is the tendency of the tensioning nut to travel up the threads on the bolt before the expansion anchor is expanded within the drill hole. That is, the initial torque applied to the tensioning nut, rather than causing rotation of the bolt and expanding the anchor, causes the tensioning nut to travel to the end of the threads with which it is engaged. Further application of torque will then expand the anchor, but the tension nut cannot travel further to tension the bolt after the anchor is fully expanded.

It is a principal object of the present invention to provide novel and improved means and methods of installation of mine roof support systems of the type wherein a bolt threaded at both ends has a mechanical expansion anchor on one end within a drill hole and a tensioning nut on the other end, outside the drill hole.

A further object is to provide means and methods for use in the foregoing type of installations which improve operation of the system without significantly increasing the cost thereof.

More specifically, the object of the invention is to provide a combination of structural elements, and methods of use thereof, which ensure that a mechanical expansion anchor on one threaded end of a mine roof support bolt is expanded to engage the wall of a bore hole before a tensioning nut travels up threads at the other end to tension the bolt.

Other objects will in part be obvious and will in part appear hereinafter.

SUMMARY OF THE INVENTION

In accordance with the foregoing objects, the invention contemplates a rock supporting and stabilizing structure wherein an elongated bar or rod is threaded for a predetermined distance from each end to provide a tensionable bolt. The tapered camming plug of a conventional mechanical expansion anchor is threadedly engaged with one end of the bolt. The other end is inserted through a central opening in each of a bearing plate and washer. A frangible jam nut is threaded on the other end of the bolt and is received in a recess in the washer. The tensioning nut is then threaded on the other end of the bolt to securely engage the jam nut.

The end of the bolt carrying the expansion anchor is placed within a blind drill hole in the rock structure and the bolt is advanced to place the bearing plate in engagement with the rock surface surrounding the open end of the hole. The tensioning nut is engaged by a wrench and torque is applied. Due to the engagement of the tensioning nut with the jam nut, torque applied to the tensioning nut is translated to rotation of the bolt. Rotation of the expansion anchor is inhibited by frictional engagement of the expansible shell with the bore hole wall. Thus, bolt rotation causes the anchor camming plug to travel axially on the bolt threads, producing expansion of the anchor in the usual manner.

After the shell is expanded into gripping engagement with the bore hole wall, continued torque applied to the tensioning nut causes the frangible jam nut to break, or its threads to be stripped free of engagement with the bolt. The tensioning nut may then travel on the bolt threads outside the bore hole, urging the washer against the support plate, and the plate against the rock surface. Depending on relative frictional forces between relatively movable elements at opposite ends of the bolt, either the camming plug may travel further down the top end of the bolt, or the tensioning nut may travel further up the bottom end as the bolt is tensioned. A predetermined torque applied to the tensioning nut provides a desired amount of tension on the bolt.

The foregoing and other features of the invention will be more readily understood and appreciated from the following detailed description, taken in conjunction with the accompanying drawings.

DETAILED DESCRIPTION

Figure 1:
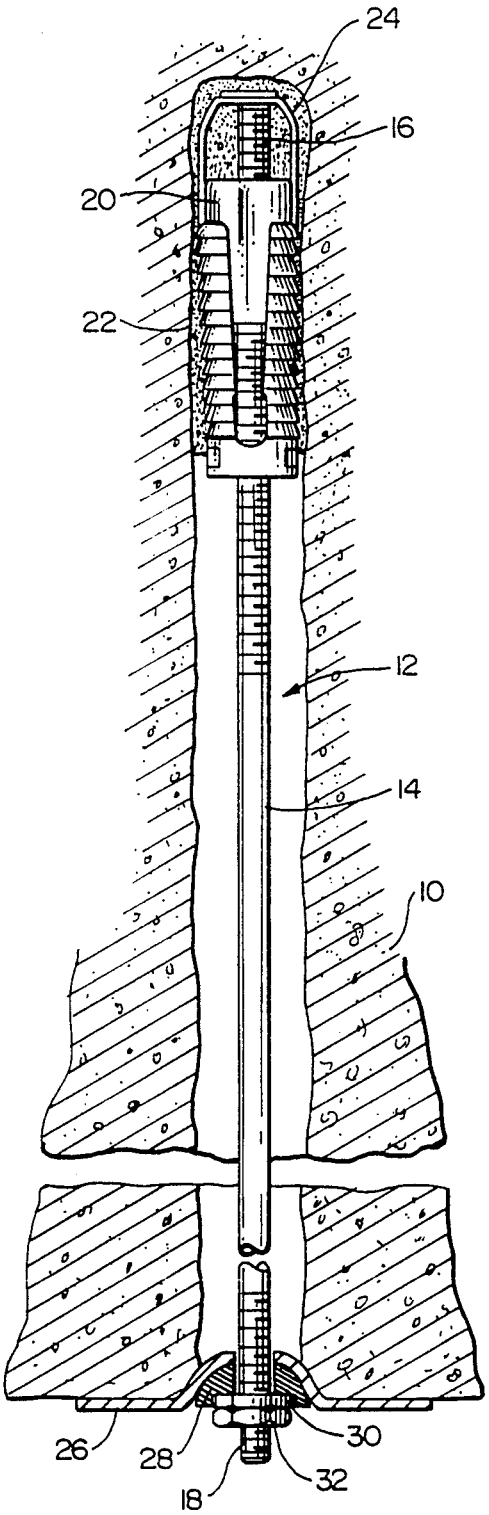
FIG. 1 is an elevational view of the rock support/-stabilizing system of the invention installed in a drill hole in a rock structure which is shown in section.

Referring now to the drawing, in FIG. 1 is shown a section of rock structure 10 in which a blind bore hole 12 of predetermined diameter and depth has been formed. Rock structure 10 is supported and stabilized by a tensioned bolt 14 having an upper end closely adjacent the blind end of bore hole 12 and a lower end extending outside the open end of the hole. Although bore hole 12 and bolt 14 are shown in a vertical orientation, and the bolt and other elements are described in installed position as having upper and lower ends, surfaces, etc., it will be understood that other orientations may be employed. Bolt 12 is threaded over a portion of its length from each end, the threads extending from the upper and lower ends being denoted by reference numerals 16 and 18, respectively.

A mechanical expansion anchor, including tapered camming plug 20, radially expansible shell 22 and bail 24, is carried on the upper end of bolt 14 by engagement of threads 16 with an internally threaded bore of plug 20. The expansion anchor is entirely conventional in all respects and any of a wide variety of commercially available designs may be employed, including types which employ means other than a bail for supporting the shell prior to expansion. The lower end of bolt 14 extends loosely through central openings in both support plate 26 and washer element 28 which are also shown in section. Jam nut 30 and tensioning nut 32 are both engaged on threads 18 a significant distance, e.g., several inches, below the termination of the threads.

In the illustrated embodiment, washer element 28 has a spherical upper surface and fits within a concave pocket formed in the lower surface of support plate 26. Such washer and support plate configurations have been employed in the past, being particularly useful in installations where the axis of the bore hole is not perpendicular to the rock formation surface, since the tensioning force of the bolt will be transmitted substantially evenly through the washer to the support plate. It will be understood, however, that washer configurations other than those having a spherical upper surface may be employed within the scope of the invention.

Figure 2:
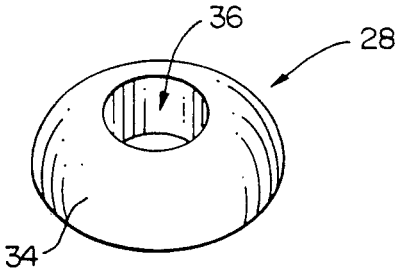
FIG. 2 is an upper, perspective view of a washer element.
Figure 3:
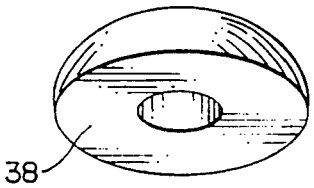
FIG. 3 Prior Art
FIG. 3 is a lower, perspective view of the washer element of FIG. 2, showing the standard, prior art configuration of the lower side thereof.
Figure 4:
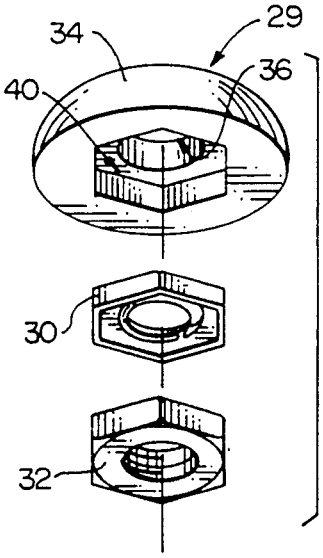
FIG. 4 is an exploded perspective view of the washer element, showing the configuration of the lower side thereof as employed in the present invention, together with two nut elements used in conjunction therewith.

The upper, spherical surface 34 of washer element 28 and central opening 36 are shown in FIG. 2. Prior art washers of this type, as seen in FIG. 3, have a flat lower surface 38 surrounding the central opening. Washer element 28, however, has a recess 40 extending into its lower surface surrounding opening 36, as seen in FIG. 4. Recess 40 has a peripheral configuration corresponding to and slightly larger than the peripheral configuration of jam nut 30. In the preferred embodiment, the peripheries of the jam nut and recess are non-circular, e.g., hexagonal, although the invention is operative even with a jam nut and washer recess of circular configuration. Also, in the illustrated embodiment, the depth of recess 40 is about the same as that of jam nut 30; however, other relative dimensions are contemplated within the scope of the invention. Thus, jam nut 30 may be threaded on the lower end of bolt 14 and received in recess 40, as shown in FIG. 1.

Tensioning nut 32 is also engaged on threads 18 and is threaded into tight engagement with jam nut 30, as also seen in FIG. 1. Jam nut 30 is not intended to bear or transmit substantial forces, but rather is broken or stripped from threads 18 when a predetermined axial force is applied thereto by tensioning nut 32. That is, the strength of jam nut 30 is sufficient to cause initial torque applied to tensioning nut 32 to be translated to rotation of bolt 14 and travel of camming plug 20 down threads 16 until shell 22 firmly engages the wall of drill hole 12. Therefore, jam nut 30 may be a stamped, sheet metal nut of the type having only a single, helical thread, as seen in FIG. 4. Such nuts have been widely used as supports for expansion anchor shells, being threaded on the upper end of bolts in place of the bail used in expansion anchors such as that shown in FIG. 1, and commonly termed "palnuts". Tensioning nut 32, on the other hand, is intended to bear and transmit loads and is therefore of more substantial construction.

The expansion anchor may be, and normally would be, placed on threads 16, and nuts 30 and 32 placed on threads 18, following insertion of the lower end of bolt 14 through the openings in plate 26 and washer element 28..by the manufacturer or other assembler of the parts. In this way, the support/reinforcing system reaches the mine or other point of use in assembled condition, ensuring proper assembly and, in particular, firm engagement of tensioning nut 32 against jam nut 30 at a significant distance below the termination of threads 18.

After bore hole 12 is drilled, bolt 14 is inserted therein until plate 26 contacts the surface of rock formation 10 around the open end of the bore hole. This is normally done with power-operated mining machinery including a wrench engaging tensioning nut 32. If desired, a conventional resin cartridge may be inserted in the drill hole ahead of the bolt and expansion anchor in known manner; however, this is a detail with which the present invention is not concerned. Torque is then applied through the wrench to nut 32. Due to its tight engagement with jam nut 30, tensioning nut 32 does not advance on threads 18, whereby rotation of the nut is transmitted directly to bolt 14. Since rotation of the expansion anchor is inhibited by frictional contact of shell 22 with the wall of bore hole 12, camming plug 20 travels down threads 16, expanding the shell into gripping engagement with the bore hole wall.

Application of torque to tension nut 32 in excess of a predetermined amount produces an axial force causing jam nut 30 to fracture, or at least to be stripped free from threads 18. This predetermined amount will be exceeded when the frictional force resisting axial movement of plug 20 into shell 22, which increases as the plug travels downwardly and the shell expands, exceeds the force required to break or strip jam nut 30. Breaking or stripping of the jam nut permits tensioning nut 32 to travel on threads 18, urging plate 26 into tighter engagement with the surface of the rock structure. Application of a given amount of foot-pounds of torque to tensioning nut 32 will produce a known tension on the anchored bolt, and thus compress and reinforce rock structure 10 in the area between the upper and lower ends of the bolt. DJepending on the relative frictional forces between the elements at the top of the bolt, i.e., the plug and shell, and those at the bottom, i.e., the nuts and washer, torque applied to tensioning nut 32 may result in further travel of either plug 20 down threads 16, or nut 32 up threads 18, or both, in the tensioning bolt 14. Thus, through employment of the present invention, the desired sequence and manner of operation is ensured, with the expansion anchor always being engaged prior to travel of the tensioning nut on the threads at the lower end to tension the bolt.

What is claimed is:

1. A support/reinforcing assembly for a rock structure adjacent an underground passageway having a bore hole of predetermined diameter therein, said assembly comprising, in combination:

a) an elongated rod threaded for at least a predetermined portion of its length from each end to provide a tensionable bolt;

b) a mechanical expansion anchor including a radially expansible shell and a tapered camming plug threadedly engaged with one end of said bolt positioned within said bore hole;

c) a bearing support plate having a central opening through which the other end of said bolt loosely passes adjacent the open end of said bore hole;

d) a washer element having a central opening through which said other end of said bolt loosely passes;

e) a frangible jam nut threadedly engaged with said other end of said bolt to retain said support plate and washer element thereon, said washer element being positioned between said support plate and an upper surface of said jam nut; and f) a tensioning nut threadedly engaged with said other end of said bolt and threaded into firm engagement with a lower surface of said jam nut a substantial distance from the end of the threads on said other end of said bolt to permit thread travel of said tensioning nut upon application thereto of a torque sufficient to break or strip said jam nut free of its threaded engagement and consequent tensioning of said bolt, 2. The assembly of claim 1 and further including a recess in a surface of said washer element facing said jam nut.

3. The assembly of claim 2 wherein the peripheral outline of said recess is larger than the peripheral outline of said jam nut, and said jam nut is essentially entirely positioned within said recess.

4. The assembly of claim 3 wherein said substantial distance is at least several inches.

5. The assembly of claim 4 wherein said recess and said jam nut have peripheral outlines of substantially the same configuration, said jam nut outline being sufficiently smaller than said recess outline to permit said jam nut to be positioned in said recess.

6. The assembly of claim 5 wherein said configuration is non-circular to prevent relative rotation of said jam nut and said washer element when said jam nut is positioned in said recess.

7. The assembly of claim 6 wherein said configuration is hexagonal.

8. The assembly of claim 7 wherein said jam nut is a stamped, sheet metal nut.

9. The assembly of claim 4 wherein the surface of said washer opposite said surface facing said jam nut is of spherical configuration, and is received in an indentation of like configuration in said support plate.

10. A method of installing and tensioning an elongated bolt, externally threaded from both ends for at least a portion of its length, in a drill hole of predetermined diameter in a rock structure adjacent an underground passageway, said method comprising:

a) positioning a mechanical expansion anchor including a radially expansible shell and a tapered camming plug on one end of said bolt with internal threads of said camming plug engaged with the threads on said one end of said bolt, said shell having a diameter substantially equal to said predetermined diameter;

b) passing the other end of said bolt through central openings of larger diameter than said bolt in both a metal support plate and a washer;

c) threadedly engaging a frangible jam nut of predetermined axial load-bearing capacity on the other end of said bolt with said washer positioned between said jam nut and said support plate, whereby said jam nut retains said support plate and said washer on said other end of said bolt, said jam nut being positioned a substantial distance from the termination of the threads on said other end of said bolt;

d) threadedly engaging a tensioning nut on said other end of said bolt into firm engagement with said jam nut;

e) inserting said one end of said bolt, with said expansion anchor thereon, into said drill hole, and advancing said bolt until said support plate engages the surface of said drill hole;

f) applying a torque to said tensioning nut sufficient to rotate said bolt, thereby causing said plug to travel axially down the threads on said one end of said bolt and expand said shell into gripping engagement with the wall of said drill hole; and g) thereafter applying a torque to said tensioning nut sufficient to apply an axial force to said jam nut in excess of said predetermined load-bearing capacity, thereby breaking or stripping said jam nut free of threaded engagement with said bolt to permit axial travel of said tensioning nut on the threads on said other end of said bolt.

11. The method of claim 10 and further including applying a torque to said tensioning nut, following said breaking or stripping of said jam nut, sufficient to produce a desired tension in said bolt.

12. The method of claim 11 wherein said substantial distance is at least several inches.

13. The method of claim 12 and further including forming a recess in the surface of said washer facing said jam nut, said recess surrounding said washer central opening and having a peripheral outline corresponding to and slightly larger than that of said jam nut, whereby said jam nut is disposed within the periphery of said recess.

14. The method of claim 13 wherein said peripheral outline is non-circular, thereby preventing substantial relative rotation of said washer and said jam nut on said other end of said bolt.

15. The method of claim 14 wherein said outline is hexagonal.

* * * * *